US005522621A

United States Patent [19]

Schneider

[11] Patent Number: 5,522,621

[45] Date of Patent: Jun. 4, 1996

[54] WALKING ATTACHMENT FOR IN-LINE SKATE

[76] Inventor: Cynthia Schneider, P.O. Box 860, Sun Valley, Id. 83353

[21] Appl. No.: 334,489

[22] Filed: Nov. 4, 1994

Related U.S. Application Data

[63] Continuation-in-part of Ser. No. 898,022, Jun. 12, 1992, abandoned.

[51] Int. Cl.[6] ..... A63C 3/12

[52] U.S. Cl. ..... 280/825; 280/811; 280/11.22

[58] Field of Search ..... 280/7.13, 7.14, 280/8, 11.19, 11.2, 11.22, 809, 811, 825

[56] References Cited

U.S. PATENT DOCUMENTS

| | | | |
|---|---|---|---|
| D. 237,639 | 11/1975 | Melnechenko . | |
| D. 242,938 | 1/1977 | Famolare, Jr. . | |
| 2,323,049 | 6/1943 | Johnson | 280/825 |
| 3,015,492 | 4/1960 | Kesner et al. | 280/825 |
| 3,135,526 | 6/1964 | Johns . | |
| 3,861,697 | 2/1975 | Dolce . | |
| 3,898,749 | 8/1975 | Famolare, Jr. . | |
| 4,355,474 | 10/1982 | Grim . | |
| 4,364,187 | 12/1982 | Melendez . | |
| 4,382,615 | 5/1983 | Gronborg et al. . | |
| 4,382,616 | 5/1983 | Olivieri . | |
| 4,392,674 | 7/1983 | Evon . | |
| 4,413,842 | 11/1983 | Loredo . | |
| 5,183,292 | 2/1993 | Ragin, III . | |
| 5,236,224 | 8/1993 | Anderson et al. | 280/11.22 |
| 5,290,065 | 3/1994 | Kassal . | |
| 5,303,955 | 4/1994 | Zurnamer | 280/825 |
| 5,445,415 | 8/1995 | Campbell . | |

*Primary Examiner*—Brian L. Johnson
*Assistant Examiner*—Min Yu
*Attorney, Agent, or Firm*—Lyon & Lyon

[57] ABSTRACT

A tread or cover for an in-line skate provides a walking surface to enable the skater to traverse unpaved areas, stairs, or steep grades. The cover is formed like a sheath which stretchably fits over the in-line skate wheels. The cover is at least slightly elastic and flexible, preferably having rubber walls. A tread pattern on the bottom surface of the cover increases traction. A strap on the cover is used to better secure the cover over the skate wheels.

10 Claims, 6 Drawing Sheets

Fig. 10
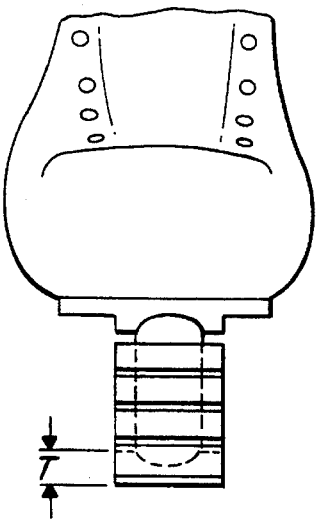
Fig. 12
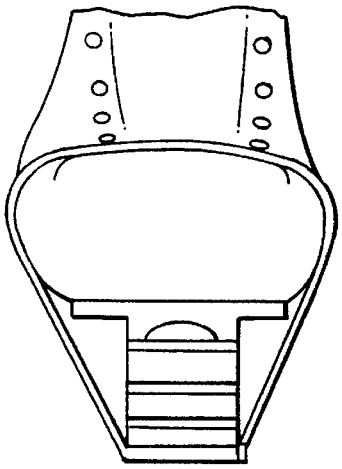
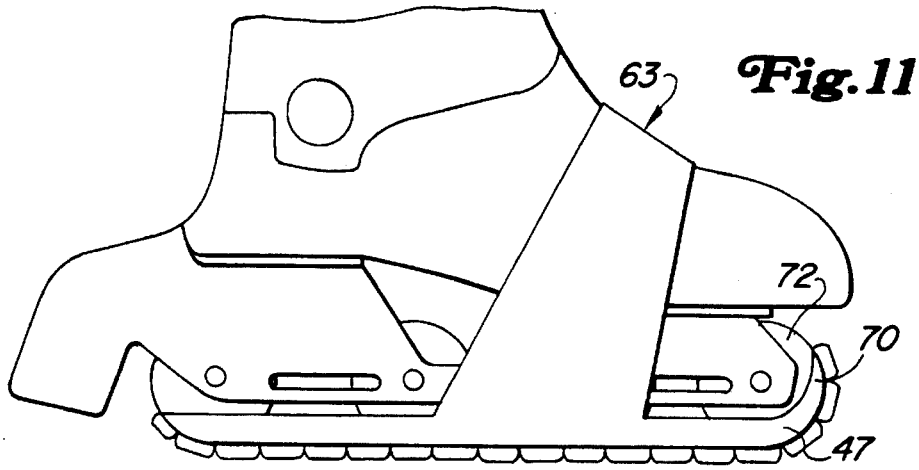
Fig. 11
Fig. 13
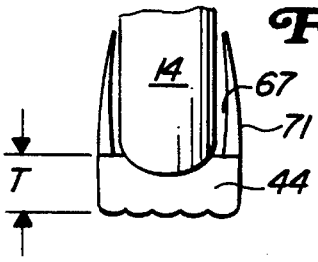
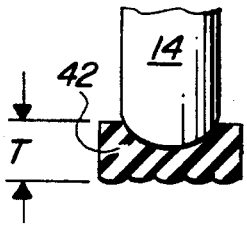
Fig. 14
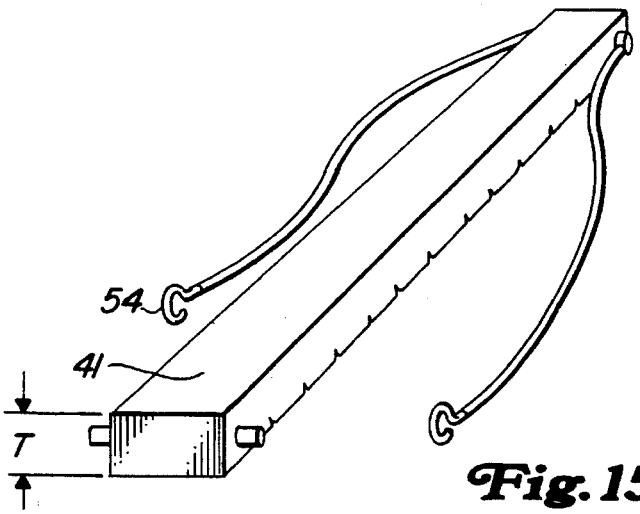
Fig. 15

WALKING ATTACHMENT FOR IN-LINE SKATE

BACKGROUND OF THE INVENTION

This application is a continuation-in-part of U.S. patent application Ser. No. 07/898,022, filed Jun. 12, 1992 and now abandoned.

In-line skates have a shoe or boot which is laced, buckled or strapped onto the skater's feet. A wheel housing is attached to the bottom or sole of the shoe or boot of the in-line skate. The wheel housing rotatably supports typically three, four, five or six in-line wheels. The housing generally covers the top portion of the wheels, leaving the lower portion of the wheels exposed for rolling contact with the ground.

In-line skating has become a universal sport enjoyed by millions of skaters, including in-line speed skaters and hockey players, of all ages. However, it can be difficult to move across non-paved areas, negotiate stairs, enter buildings, or traverse steep grades, while wearing in-line skates. Switching to conventional footwear for these activities is time consuming, inconvenient, and requires that the in-line skater carry extra footwear. In addition, skate wheel bearings are subject to contamination and premature wear if the in-line skater attempts to walk across soil, sand, gravel, stones, etc. Moreover, many business establishments restrict the use of in-line skates on their premises. Some skate wheels can leave marks on certain floor surfaces.

Not only do in-line skates come with varying numbers of wheels, but the skate wheel diameters and spacings between wheels also vary between skates. Accordingly, there is substantial variance of the length of the wheel housing, and the front wheel to back wheel distance, among different skate designs. In addition, with most pairs of in-line skates, the right skate includes a brake extending from the back of the wheel housing.

Although various skate guards or soles have been proposed for use with ice skates and conventional four-wheel roller skates, these devices are unsuitable for use with in-line skates, for a variety of reasons arising from the unique designs and characteristics of in-line skates. Typically, known ice skate and conventional four-wheel roller skate guards cannot readily accommodate the presence or absence of an in-line skate brake, cannot accommodate the variations in wheel spacings and length of in-line skates, or are inappropriate for use with in-line skates where the wheel housing covers the upper portion of the wheels. The only previously known in-line skate cover, as described in U.S. Pat. No. 5,183,292, has a sole which is strapped over the wheels when in use and is strapped to the back of the skate when not in use. The design, however, has not enjoyed widespread use or success, apparently due to various disadvantages.

SUMMARY OF THE INVENTION

Accordingly, it is an object of the invention to provide a better skate wheel cover for in-line skates.

To this end, a cover for wheels of an in-line skate includes an elongate resilient member which can be attached over the wheels of an in-line skate. Preferably, the cover has raised front and rear wheel sections which substantially enclose the exposed sector of the front and rear wheels, to help secure the cover in place and provide for better safety when the skater is walking. The center section of the cover which fits over the middle skate wheels is advantageously somewhat elastic to allow the cover to be stretched over the skate wheels. In a preferred embodiment, a strap on the cover is provided to better secure the cover in place over the wheels.

BRIEF DESCRIPTION OF THE DRAWINGS

Other objects and features of the present invention will become apparent from the following detailed description taken in connection with the accompanying drawings, which disclose several embodiments of the invention. It is to be understood, however, that the drawings are designed for the purpose of illustration only and are not intended as a definition of the limits of the invention.

In the drawings, wherein similar reference characters denote similar elements throughout the several views:

FIG. 10 is a front elevation view of the cover and skate of FIG. 9;

FIG. 11 is a side elevation view of a seventh embodiment of the present skate wheel cover;

FIG. 12 is a front elevation view of the skate and cover of FIG. 11;

FIG. 13 is a section view fragment of the skate wheel cover of FIG. 6 around a skate wheel;

FIG. 14 is a section view fragment of the skate wheel cover of FIG. 1 engaging a skate wheel;

FIG. 15 is a perspective view of the skate wheel cover of FIG. 4 prior to installation onto an in-line skate;

DETAILED DESCRIPTION OF THE PREFERRED EMBODIMENTS

Figure 1:
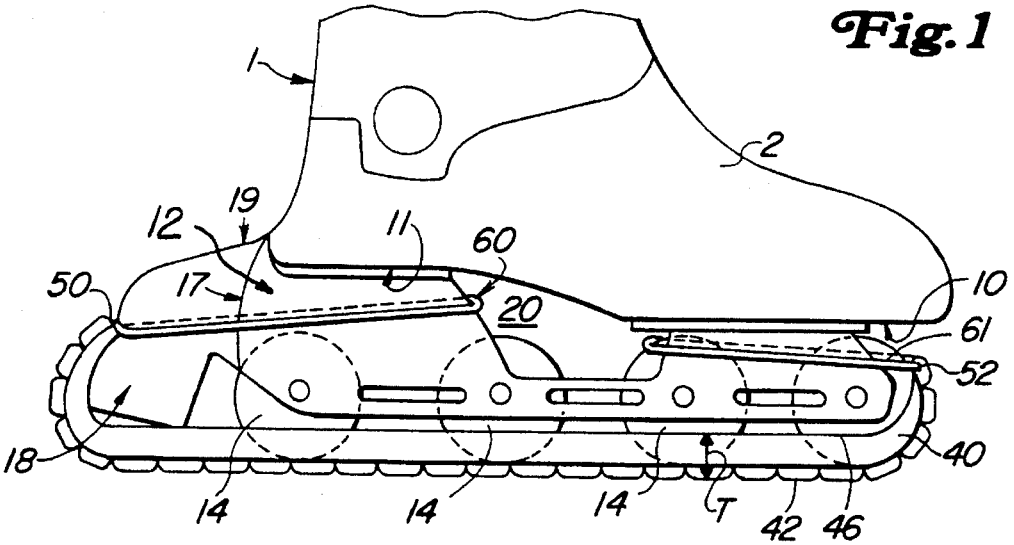
FIG. 1 is a side elevation view of the present in-line skate wheel cover on an in-line skate having a rear brake.
Figure 2:
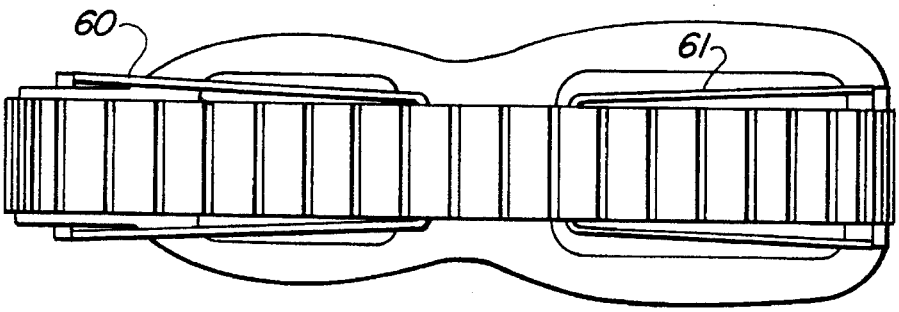
FIG. 2 is a bottom elevation view of the cover of FIG. 1.
Figure 3:
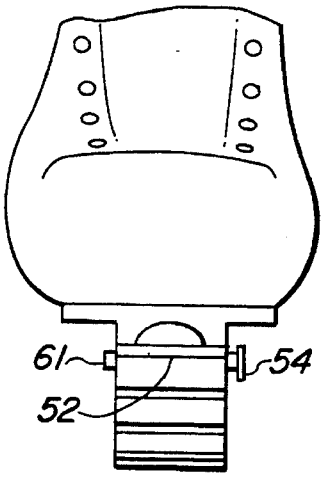
FIG. 3 is a front elevation view of the skate and cover of FIG. 1.

Turning to FIG. 1, an in-line skate 1 has a shoe or boot 2 which is laced, buckled or strapped onto the wearer's foot. A skate wheel housing 12 is generally made of plastic and is attached to the sole 10 of the boot 2. The housing 12 supports the skate wheels 14 in-line. The skates shown in the figures, for illustration purposes, are shown with four wheels. However, a line of 3, 4, 5 or 6 wheels of varying diameters may be provided on different brands and models of in-line skates.

The housing 12 covers only the top portion of the wheels 14, with a lower fractional portion of the wheel extending below the housing, for rolling contact with the ground.

A brake 18 is provided, typically in the form of a rubber pad, on the rear of the housing 12. On some models, both the right and left in-line skates have brakes. On other models, only the right skate has a brake. For illustration purposes only, the skates in the figures are shown with a brake. The brakes 18 typically provide an upward facing engageable surface 19 extending between the brake and the heel of the boot 2.

Referring to FIGS. 1, 2, 3 and 14, a tread 40 preferably comprises a single piece of stretchy, tough polymer. The tread 40 has lugs, cleats, or a tread-pattern design 42 molded into its bottom or walking surface. The tread 40 has sufficient elasticity and thickness T to enable the wheels 14 to sink into the tread material 40, to inhibit or prevent rolling of the wheels 14. The top surface 46 of the tread 40 which contacts the wheels 14 is flat and smooth. Attaching the tread 40 to the boot 2 of the in-line skate 1 or to the housing 12 enables the skater to walk without rolling.

There are several features generally common to all in-line skates, regardless of size, which can be used to attach the tread 40 to the skate 1 to provide a walking surface. For example, on virtually all in-line skates, there is an open area 20 between the attachment of the housing to the front sole 10 of the boot 2 (i.e., the ball of the foot area) and the attachment of the housing 12 to the heel area 11 of the boot 2.

In the embodiment of FIG. 1, the tread 40 or cover stretches over the brake 18, if present. If no brake is present, the tread 40 reaches up and at least partially over the heel portion 17 of the housing 12. An elastic cord 60, such as a bungee cord, is attached at one end of the rear edge 50 of the tread 40. The loose end of the cord 60 can be stretched forward and through the open area 20, around the rear portion of the housing 12 and attached to the rear edge 50 of the tread, using e.g., hooks and metal loops 54, or with Velcro hook and loop tape. Attachment of the toe portion 52 of the tread 40 is similar to the attachment of the heel portion of the tread. A toe portion elastic cord 61 has one end permanently attached to the toe portion 52. The free end of the cord 61 is stretched back and through the open area 20, around the front section of the housing 12 and attached to the toe portion 52 of the tread 40, also using hooks and metal loops 54 or Velcro hook and loop fastener tape.

Figure 4:
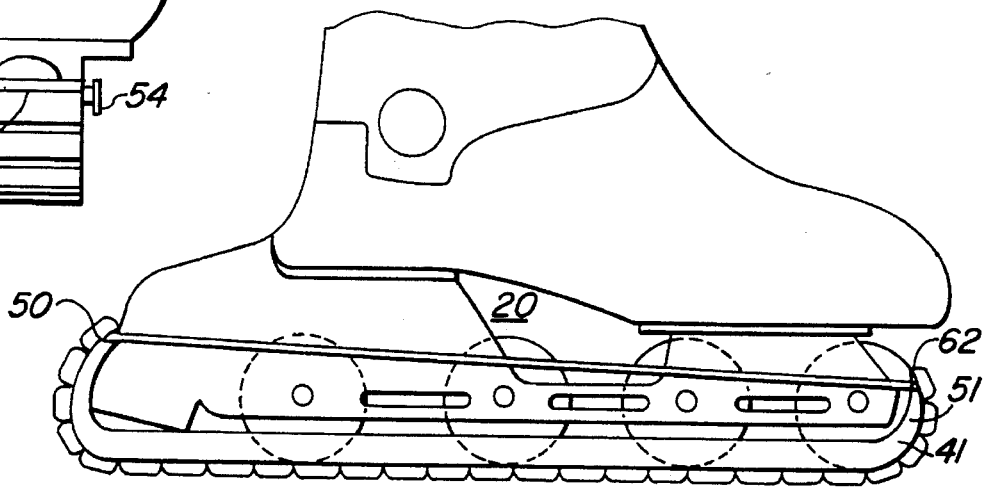
FIG. 4 is a side elevation view of a second embodiment of the present cover installed on an in-line skate having a rear brake.

Turning to FIGS. 4 and 15, in a second embodiment, a tread 41 is similar to the tread 40 of FIG. 1 except a pair of elastic cords 62 are extendable directly from the rear edge 50 of the tread 41 to the front edge 51 at the toe section. One elastic cord 62 of the pair extends down each side of the housing 12, bypassing the open space 20, and attaching to the front edge of the tread 41 using hooks and metal loops or Velcro hook and loop fastener tape.

The treads 40 and 41 do not reach above the wheels and have no recesses or slots to accommodate the in-line skate wheels 14. Correspondingly, the treads 40 and 41 have no lip or shoulder extension. The wheels 14 are accommodated into the tread by the skater's weight on the relatively hard wheels 14 indenting or pressing into the relatively softer tread 40 or 41.

Figure 5:
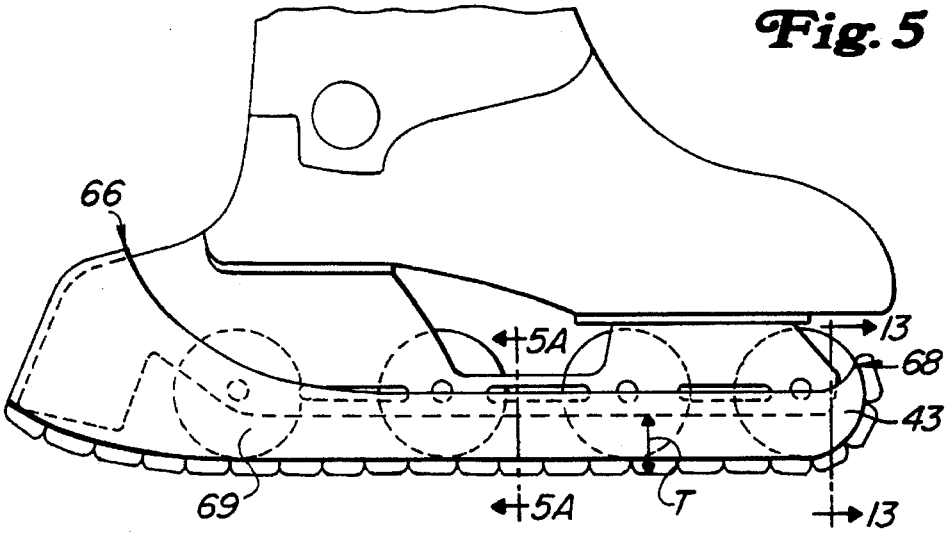
FIG. 5 is a third embodiment of the present cover installed on an in-line skate having a rear brake.
Figure 5A:
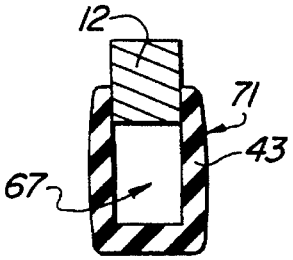
FIG. 5A is a partial section view taken along line 5*a*—5*a* in FIG. 5.

Turning to FIG. 5 and 5*a*, in a third embodiment, the tread 43 has a canoe-shape. The stretchable material of the tread 43 stretches over the skate much like a rubber rain shoe fits around a men's shoe. The material thickness T preferably is the same as in treads 40 and 41. The tread 43 requires no separate attachment mechanism per se. A central slot, wide enough to accommodate the wheels 14 and housing 12 extends from the toe section 68 to the heel section 66. The side walls 69 on either side of the channel 67 stretch up past the plane of the bottoms of the wheels and onto the housing 12 sufficiently to allow the elasticity of the tread material to hold the tread 43 securely around the entire housing 12, including a brake, if present.

Figure 6:
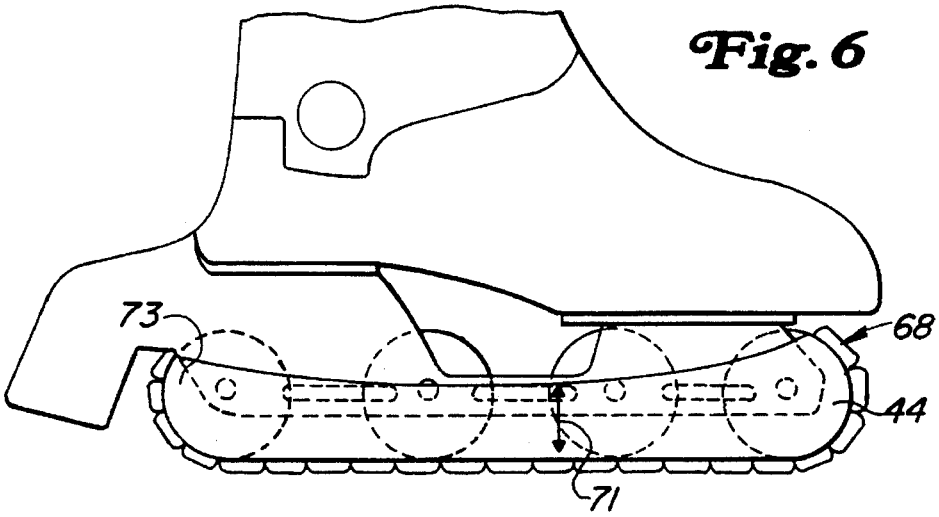
FIG. 6 is a fourth embodiment of the present cover installed over the wheels of, but not over the brake of, an in-line skate.
Figure 7:
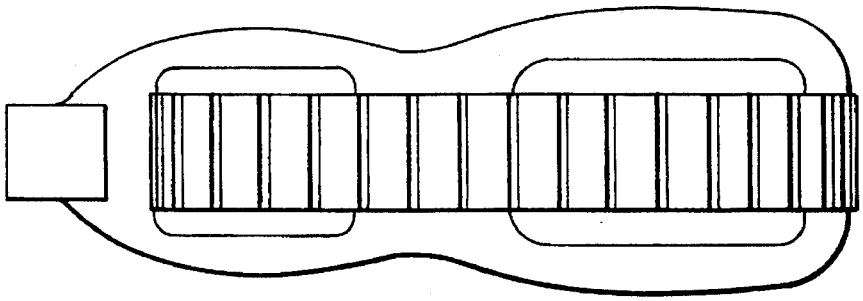
FIG. 7 is a bottom view of the cover and skate shown in FIG. 6.

In a fourth embodiment, as shown in FIGS. 6, 7 and 13, a tread 44 has a channel 67. However, with tread 44, there is no enlarged heel section (in contrast to the embodiment of FIG. 5). Due to the stretching of the tread material, and the height of the walls 71, the tread 44 can be attached to the skate by stretching the heel 73 over the last or rear most wheel of the skate.

Turning to FIGS. 8–12, in additional alternate embodiments, the tread thickness T is similar to the thickness shown in FIG. 1–7. However, the material of the tread is attached or laminated onto a more rigid pre-shaped material 75. This enables the toe 70 to be molded to conform to the approximate shape of the front wheel 72. As the tread of FIGS. 8–12 is drawn back against the front wheel 72, the front wheel 72 is forced into the softer material 74 laminated or attached onto the inside of the tread.

Figure 8:
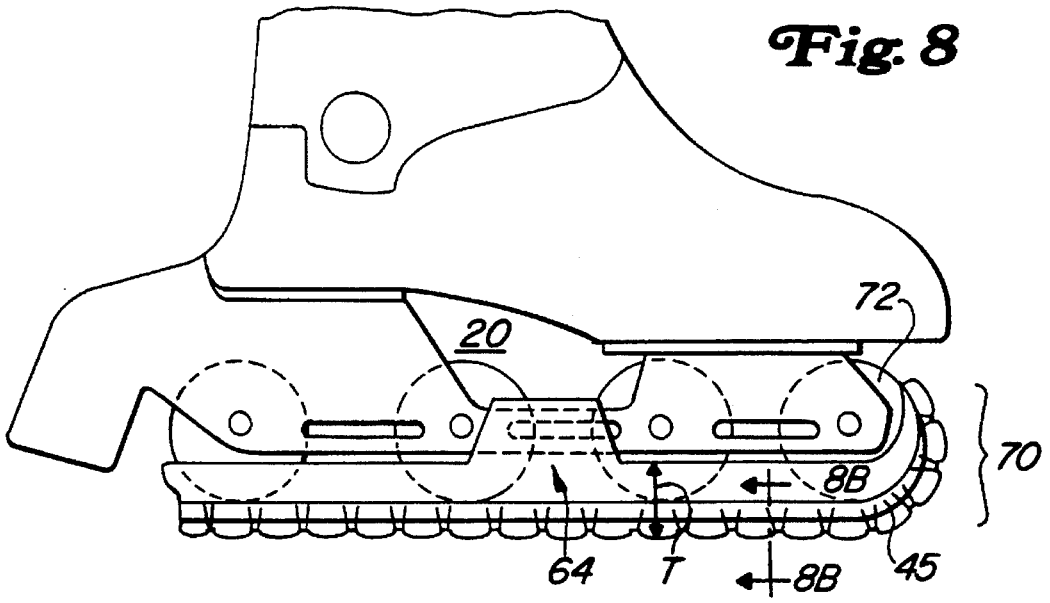
FIG. 8 is a fifth embodiment installed over the wheels, but over the brake of, an in-line skate.
Figure 8B:
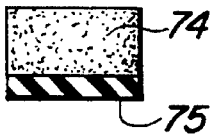
FIGS. 8*a* and 8*b* are section views of the cover of FIG. 8.
Figure 8A:
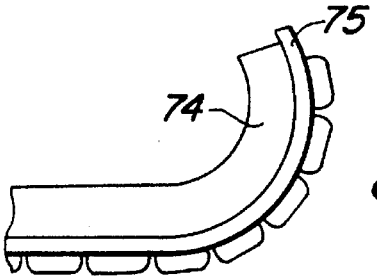

In the embodiment of FIG. 8, an elastic strap 64 passes through the open space 20 between the housing 12 and the boot 2. The strap 64 is permanently attached on one side of the tread 45, passes through the opening 20 and attaches to the other side of the tread 45 using a mechanical fastener or Velcro hook and loop tape.

Figure 9:
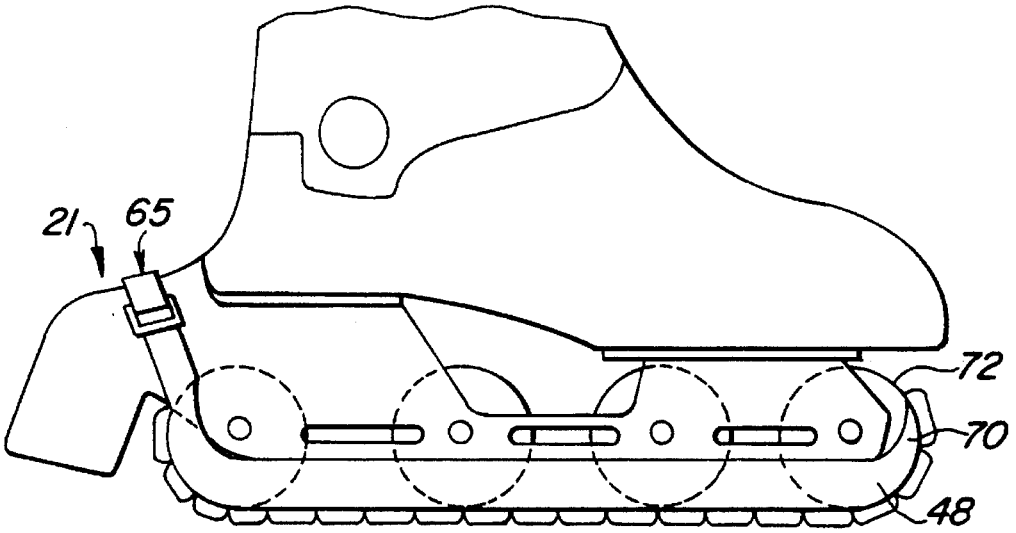
FIG. 9 is a side elevation view of a sixth embodiment of the present cover installed over the wheels of an in-line skate.

In the embodiment of FIG. 9, the rear or back end of the tread 48 is attached to the relatively flat area above the brake or the back of the heel 21, by passing a strap 65 from one side of the flat area to the other side for attachment to the tread 48 by mechanical fastener or by Velcro hook and loop tape. FIG. 10 illustrates the compression of the soft material of the tread by the skate wheels.

In the embodiment of FIGS. 11 and 12, a large strap 63 reaches from one side of the tread 47 across the vamp of the boot, and attaches to the other side of the tread 47, using a hook and loop attachment or Velcro hook and loop tape.

FIG. 14 schematically illustrates compression of the elastic material of a tread by a skate wheel 14.

As described, the present treads provide a stable walking surface for users of in-line skates. The tread can be quickly and easily placed onto and removed from an in-line skate, while the skate is on the wearer's foot. After it is removed, the tread can be attached around the skater's waist. Although three sizes (small, medium and large) may be required to accommodate skate sizes and the presence or absence of a brake, these sizes can generally accommodate all of the various differing design features and sizes of in-line skates, with the various attachment provisions shown and described. The treads can be manufactured in various colors to match specific skate or skating attire colors. PVC or injection molded urethane are suitable tread materials, although others may be used as well. Velcro tape sections are advantageously applied at the heel and toe sections of the treads to allow them to be looped belt-like around the skater's waist, when the treads are not in use on the skates. The present treads, when installed, create a walking surface for in-line skates. In addition, the treads provide a protective cover for the wheels (and to a lesser extent, the bearings of the wheels when the skater moves across unpaved areas.

Figure 16:
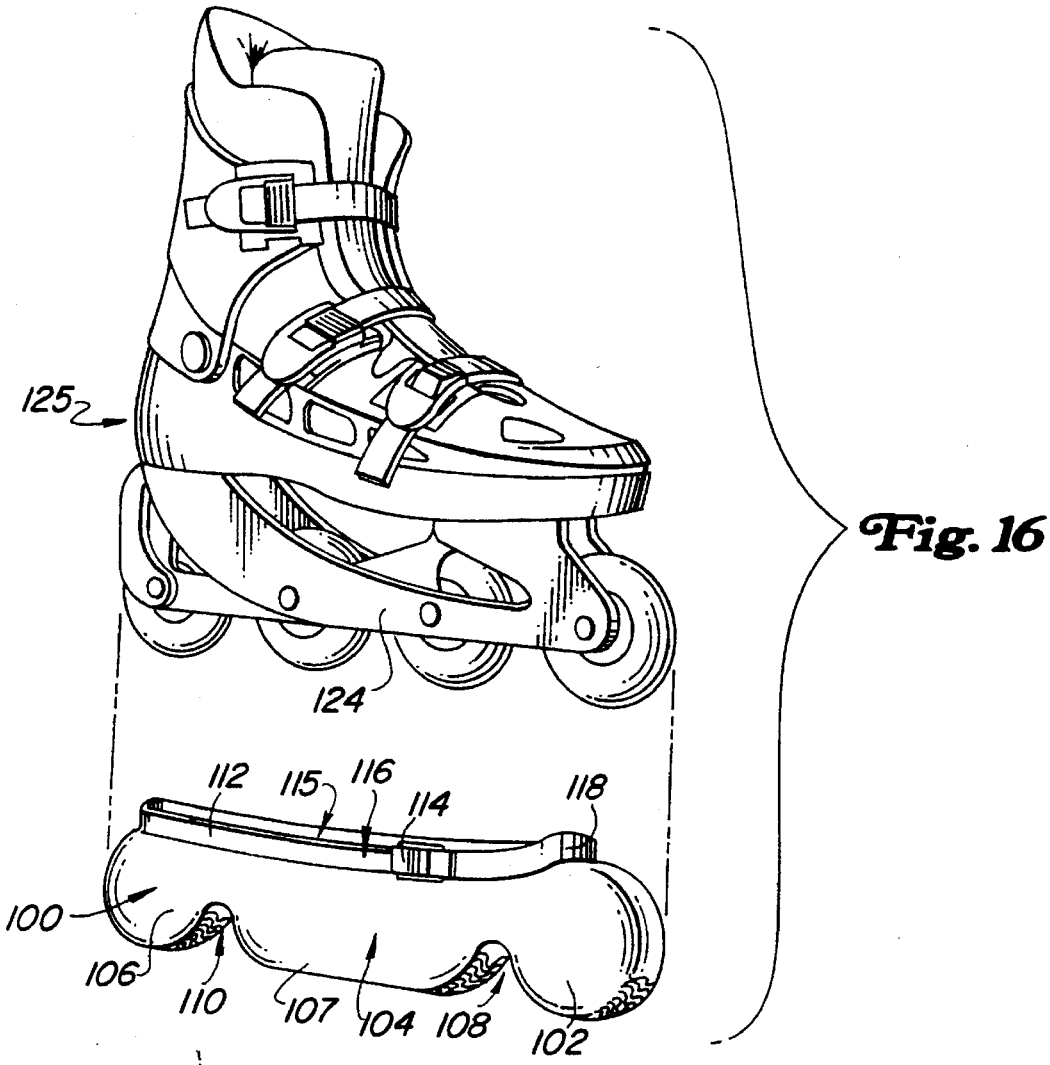
FIG. 16 is an exploded perspective view of another embodiment of the skate wheel cover and an in-line skate.

Turning to FIG. 16, another skate cover embodiment 100 is advantageously formed as a sheath. A front wheel section 102 is separated from a central section 104 by a forward indentation 108. A rear wheel section 106 is separated from the central section 104 by a rear indentation 110. The skate cover 100 has an open top slot 115 surrounded by a preferably continuous perimeter wall 116. The top slot 115 is dimensioned to be wide enough to fit over the wheel frame 124 of the in-line skate 125, and is long enough in the front to back direction to receive the skate wheels.

A front tab wall 118 projects upwardly from the front wheel section 102. Similarly, a rear tab wall 120 projects upwardly from the rear wheel section 106, with the front tab wall 118 higher than the rear tab wall 120, and with the front and rear tab walls forming the front and back of the top perimeter wall 116.

Figure 17:
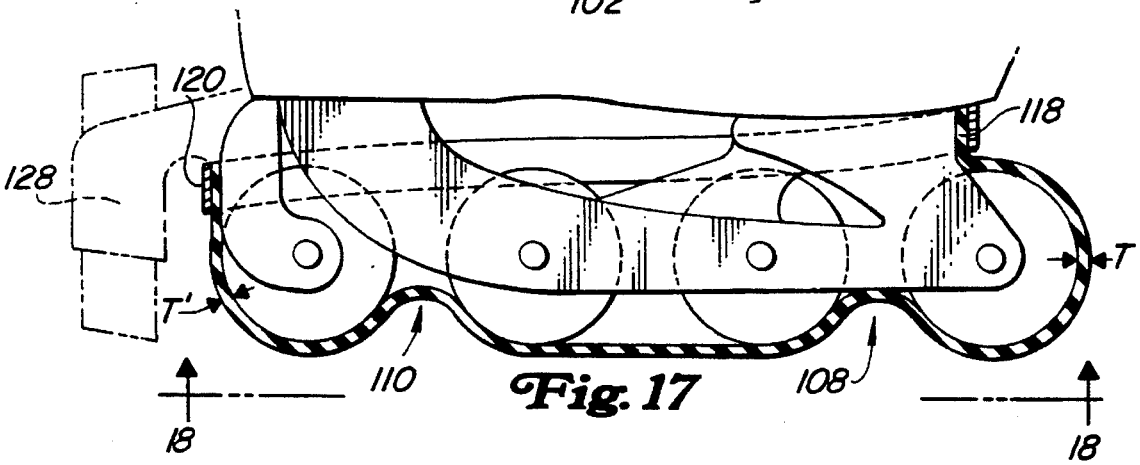
FIG. 17 is a partial section view of the skate cover of FIG. 16 installed on an in-line skate.

An elastic strap 112 is stitched and/or bonded onto the top perimeter 116, and includes a buckle 114. As shown in FIG. 17, the strap and wall 116 include downwardly from back to front.

Figure 18:
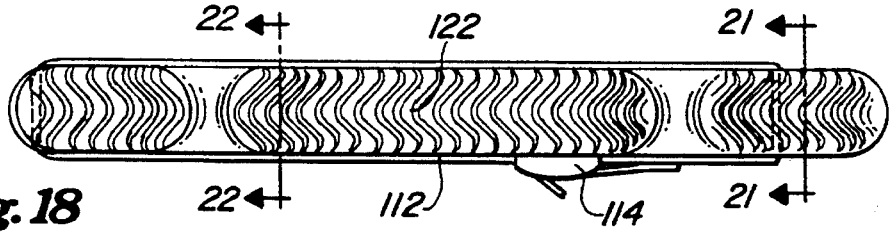
FIG. 18 is a bottom view of the in-line skate cover of FIG. 16.

As shown in FIG. 18, a tread pattern is advantageously provided on the bottom surface of the skate cover 100. The tread pattern may be in a variety of styles, and helps the cover to better grip the group.

FIGS. 16–18 show an embodiment 100 for use on a four wheel in-line skate, without a heel brake. For use on an in-line skate having a heel brake 128 (shown in phantom in FIG. 17), the skate cover 100 is made longer, so that it can fit over the heel brake. In addition, for in-line skates having five wheels, the skate cover 100 is made longer, by lengthening the central section 104 to accommodate the three central wheels (with no indentations, such as 108 and 110, between the three central wheels).

The skate cover 100 is generally symmetrical from side to side, and will fit on a left or right in-line skate, so long as the length of the skate cover can accommodate the number of wheels on the skate and fit over a heel brake, if present. (i.e., so that the skate cover 100 can accommodate the length of the skate).

As skates may have different spacings between the wheels, and different diameter wheels, the skate cover 100 is provided in varying lengths to fit different skates, by lengthening or shortening the flat central section 104.

Figure 21:
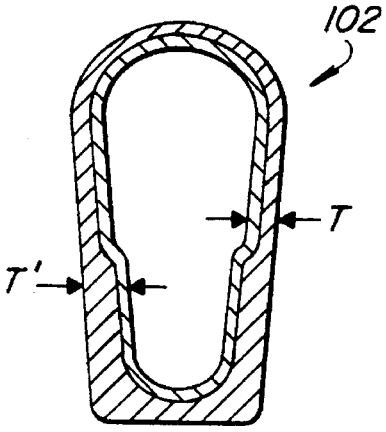
FIG. 21 is a cross-section view of the front wheel section of the skate cover taken along line 21—21 of FIG. 16.
Figure 22:
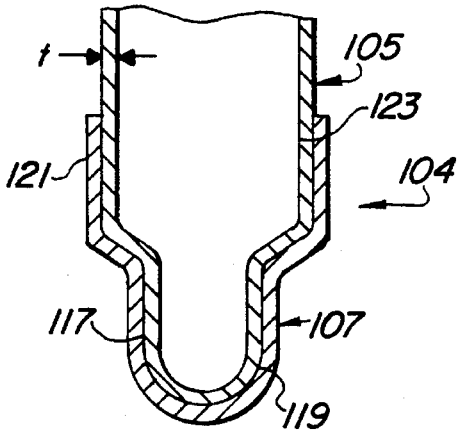
FIG. 22 is a cross-section view of the central wheel section of the skate cover taken along line 22—22 of FIG. 16.

Referring to FIGS. 17, 21 and 22, the thickness T and $T^1$ of the skate cover material at the front wheel section 102 and rear wheel section 106 is advantageously thicker than the material thickness at the upper central section 105 which is preferably made thinner, to enable the skate cover 100 to more easily be stretched, to install it onto an in-line skate. In contrast, the front and rear wheel sections are made thicker to better resist the wear and pulling/peeling forces exerted at the front and rear wheels of the in-line skate. The lower central section 107 is advantageously also of thickness T, to resist wear, but may be made thinner so that the cover stretches more easily.

In use, the skate cover 100 is attached to the skate 125 by placing it over the wheels, and slightly stretching the skate cover 100, which is preferably made of a resilient material. As the skate cover 100 is stretched over the wheels, the elastic strap 112 stretches with the skate cover material. After the front and rear wheel sections are securely positioned over the wheels, the elastic strap 112 is tightened via the buckle 114, to secure the skate cover 100 onto the skate 125.

Referring to FIG. 17, the front tab wall 118 of the skate cover 100, placed over the top of the front wheel, and held in place with the elastic strap 112, keeps the skate cover 100 on the wheels, even when the user climbs stairs, or otherwise kicks or pushes off with the front wheel of the skate. Similarly, the rear tab wall 120, although below the position of the front tab wall 118, is positioned high up on the rear wheel, to reduce or eliminate any tendency for the skate cover 100 to be peeled or rolled off of the skate 125, during walking or climbing movements of the skate.

The lower sidewalls 117 and 119, as shown in FIG. 22, are spaced apart and form a slot 121 between them adapted to receive the wheels of the skate. The upper sidewalls 121 and 123 are joggled out to a wider slot, to fit over the wheel frame, as shown in FIG. 17. The joggle is located slightly below the wheel centerlines, where the frame begins, and the indentations 108 and 110 extend to approximately the height of the joggle.

Preferably, the skate cover is made by dipping a mold patterned on an in line skate, into liquid PVC which then dries and solidifies. Thicker sections are built up by multiple dips. Other manufacturing methods and materials may also be considered.

The resilient rubber or plastic material advantageously forms all of the skate cover features, except for the elastic strap 112 which is subsequently attached. Artwork or logos may be placed on the broad flat sides of the skate cover 100. An advantage of having the skate cover made of relatively thin and resilient material, is that the skate cover can be compactly folded or rolled into an exceptionally compact package, for storage, shipping and handling, and especially when they are carried by the skate when not in use. Advantageously, the only rigid part on the skate cover 100 may be the buckle 114, which, of course, is itself small in size and does not substantially interfere with rolling, folding or compacting the skate cover.

An advantage of the present skate cover 100 is that (when appropriately sized) it can fit onto virtually any in-line skate, without requiring any modifications to the skate, or any additional straps, clips, etc.

Figure 19:
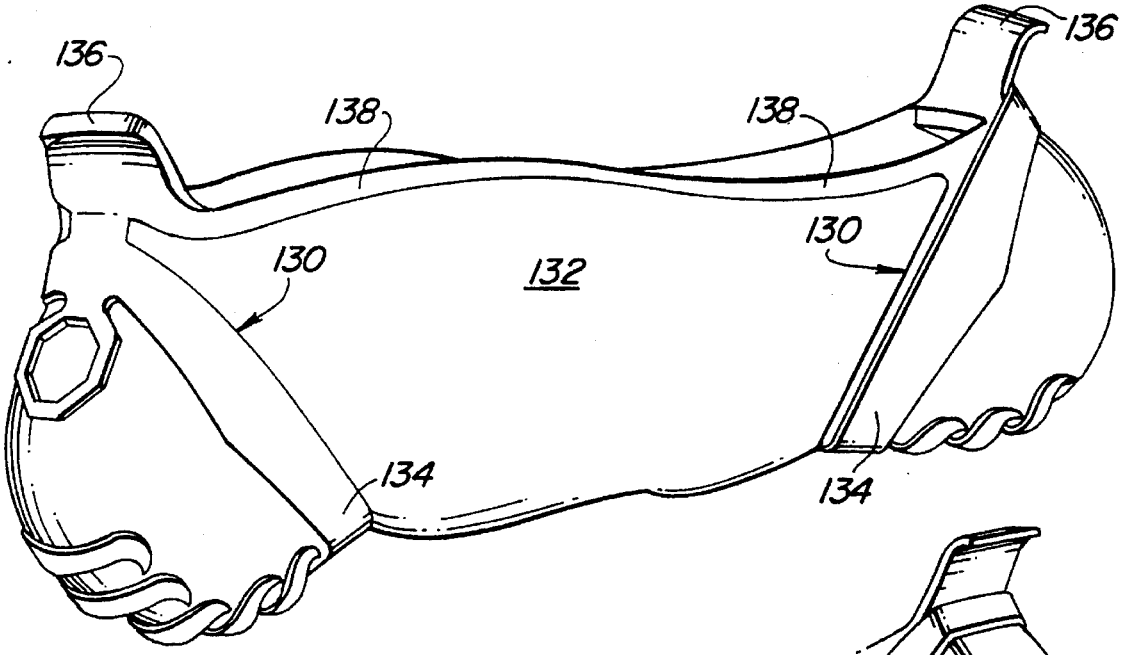
FIG. 19 is a perspective view of another embodiment similar to FIG. 18.
Figure 20:
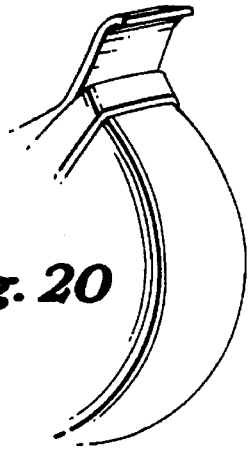
FIG. 20 is a partial perspective end view of the skate cover of FIG. 19.

FIG. 19 shows "dip lines" 130 and an "elastic zone" 132 of thinner material to provide stretch at the central area of the cover. A reinforcement bead 138 preferably surrounds the top open perimeter 116. Pull tabs 136 may be provided at the upper ends, to more easily facilitate installation and removal of the skate cover from a skate. Reinforcement bands 134 are preferably provided inbetween the central section and the front and rear wheel sections. The reinforcement bands 134 and bead 138 may be on the outside or the inside of the cover, and can be molded or formed in place.

Thus, while several embodiments of the present invention have been shown and described, it would be obvious that many changes and modifications may be made thereunto, without departing from the spirit and scope of the invention.

The invention, therefore, should not be limited, except in the spirit of the following claims.

I claim:

1. A cover for front, central, and rear wheels rotatable supported on a frame of an in-line skate comprising:

a front wheel section for covering a front wheel of the in-line skate, and having an interior wall with a raised portion adaptable to fit between a pair of wheels substantially contoured in a radius to match the shape of the front wheel of the in-line skate;

a rear wheel section for covering a rear wheel of the in-line skate, and having an interior surface with a raised portion adaptable to fit between a pair of wheels substantially contoured in a radius to match the shape of the rear wheel of the in-line skate; and a central section for covering at least one central wheel and adjoining both the front and rear wheel section, the front wheel, central, and rear wheel sections also forming a top perimeter wall defining an elongate slot dimensioned to be able to fit over the frame of the in-line skate.

2. The cover of claim 1 further comprising an indentation between the front wheel section and the central section.

3. The cover of claim 1 further comprising a strap around the top perimeter wall.

4. The cover of claim 1 further comprising a tread pattern on a bottom surface of the cover.

5. The cover of claim 1 wherein the cover is a molded flexible unit.

6. The cover of claim 1 wherein the front wheel section has a wall thickness greater than that of the central section.

7. The cover of claim 1 wherein the front and rear wheel sections have a greater wall thickness than the central section.

8. A cover for front, central, and rear wheels rotatably supported on a frame of an in-line skate comprising:

a front wheel section for covering a front wheel of the in-line skate, and having an interior wall with a raised portion adaptable to fit between a pair of wheels substantially contoured in a radius to match the shape of a front wheel of the in-line skate;

a rear wheel section for covering a rear wheel of the in-line skate, and having an interior surface with a raised portion adaptable to fit between a pair of wheels substantially contoured in a radius to match the shape of a rear wheel of the in-line skate;

a central section for covering at least one central wheel and adjoining both the front and rear wheel sections, the front wheel, central, and rear wheel sections also forming a top perimeter wall defining an elongate slot dimensioned to be able to fit over the frame of the in-line skate; and an elastic strap around the top perimeter wall of the cover.

9. A cover for front, central, and rear wheels rotatably supported on a frame of an in-line skate comprising:

a front wheel section for covering a front wheel of the in-line skate, and having an interior wall with a raised portion adaptable to fit between a pair of wheels substantially contoured in a radius to match the shape of a front wheel of the in-line skate;

a rear wheel section for covering a rear wheel of the in-line skate, and having an interior surface with a raised portion adaptable to fit between a pair of wheels substantially contoured in a radius to match the shape of a rear wheel of the in-line skate; and a central section for covering at least one central wheel and adjoining both the front and rear wheel sections, the front wheel, central, and rear wheel sections also forming a top perimeter wall defining an elongate slot dimensioned to be able to fit over the frame of the in-line skate, said elongate slot having substantially the same width at the front, central, and rear wheel sections.

10. A combination of an in-line skate and a removable cover for the wheels of said in-line skate, said combination comprising:

a boot;

an elongate wheel frame attached lengthwise to the sole of said boot;

a set of linearly aligned wheels rotatably supported on said frame, including a front wheel, a rear wheel, and at least one central wheel between said front and rear wheels;

a cover for said front, central, and rear wheels comprising:

a front wheel section for covering a front wheel of the in-line skate, and having an interior wall with a raised portion adaptable to fit between a pair of wheels substantially contoured in a radius to match the shape of a front wheel of the in-line skate;

a rear wheel section for covering a rear wheel of the in-line skate, and having an interior surface with substantially contoured in a radius to match the shape of a rear wheel of the in-line skate; and a central section for covering at least one central wheel and adjoining both the front and rear wheel sections, the front wheel, central, and rear wheel sections also forming a top perimeter wall defining an elongate slot dimensioned to be able to fit over the frame of the in-line skate.

* * * * *